US012702169B2

(12) United States Patent
Lee

(10) Patent No.: US 12,702,169 B2
(45) Date of Patent: Aug. 11, 2026

(54) AEROSOL GENERATING DEVICE

(71) Applicant: KT&G CORPORATION, Daejeon (KR)

(72) Inventor: Jaemin Lee, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 693 days.

(21) Appl. No.: 17/596,452

(22) PCT Filed: Sep. 7, 2021

(86) PCT No.: PCT/KR2021/012102
§ 371 (c)(1),
(2) Date: Dec. 10, 2021

(87) PCT Pub. No.: WO2022/050813
PCT Pub. Date: Mar. 10, 2022

(65) Prior Publication Data

US 2023/0148679 A1 May 18, 2023

(30) Foreign Application Priority Data

Sep. 7, 2020 (KR) ..... 10-2020-0113743
May 20, 2021 (KR) ..... 10-2021-0064734

(51) Int. Cl.
*A24F 40/57* (2020.01)
*A24D 1/20* (2020.01)

(52) U.S. Cl.
CPC ..... *A24F 40/57* (2020.01); *A24D 1/20* (2020.01)

(58) Field of Classification Search
CPC ..... A24F 40/57
See application file for complete search history.

(56) References Cited

U.S. PATENT DOCUMENTS 8,833,364 B2 9/2014 Buchberger
10,004,273 B1 * 6/2018 Smayda ..... H05B 6/108
(Continued)

FOREIGN PATENT DOCUMENTS

CN 111246764 A 6/2020
CN 111511233 A 8/2020
(Continued)

OTHER PUBLICATIONS

International Search Report and Written Opinion of the International Searching Authority issued Dec. 14, 2021 in International Application No. PCT/KR2021/012102.
(Continued)

*Primary Examiner* — Michael H. Wilson
*Assistant Examiner* — Michael T Fulton
(74) *Attorney, Agent, or Firm* — Sughrue Mion, PLLC

(57) ABSTRACT

Disclosed is an aerosol generating device including a heater configured to generate an aerosol by heating an aerosol generating substance; and a controller configured to control a current supplied to the heater without using feedback control such that the heater is heated to a pre-set reference temperature, and when the heater is heated to the reference temperature, control the current by using feedback control such that the heater is further heated from the reference temperature to a target temperature, based on a difference between a temperature of the heater and the target temperature.

9 Claims, 10 Drawing Sheets

(56) References Cited

U.S. PATENT DOCUMENTS

| | | | | |
|---|---|---|---|---|
| 2017/0095005 | A1* | 4/2017 | Monsees | A24F 40/46 |
| 2018/0168223 | A1 | 6/2018 | Zinovik et al. | |
| 2020/0046033 | A1 | 2/2020 | Robert et al. | |
| 2020/0329776 | A1 | 10/2020 | Lee | |
| 2021/0007393 | A1 | 1/2021 | Jung et al. | |
| 2021/0046259 | A1* | 2/2021 | Hasegawa | A61M 11/042 |
| 2021/0052835 | A1 | 2/2021 | Lee | |
| 2021/0177065 | A1 | 6/2021 | Lee | |
| 2021/0186114 | A1 | 6/2021 | Lee | |
| 2022/0218029 | A1 | 7/2022 | Mironov et al. | |

FOREIGN PATENT DOCUMENTS

| | | | |
|---|---|---|---|
| CN | 111542240 | A | 8/2020 |
| EP | 3 689 651 | A1 | 8/2020 |
| EP | 3 818 860 | A1 | 5/2021 |
| EP | 3 818 873 | A1 | 5/2021 |
| JP | 2015-13192 | A | 1/2015 |
| JP | 2020-518236 | A | 6/2020 |
| JP | 2020-108369 | A | 7/2020 |
| KR | 10-2020-0057492 | A | 5/2020 |
| WO | 2013/060781 | A1 | 5/2013 |
| WO | 2013/098397 | A2 | 7/2013 |
| WO | 2018/019786 | A1 | 2/2018 |
| WO | 2018/202403 | A1 | 11/2018 |
| WO | 2020/017789 | A1 | 1/2020 |
| WO | 2020/027448 | A1 | 2/2020 |

OTHER PUBLICATIONS

Extended Search Report dated Jul. 8, 2022 from the European Patent Office in EP Application No. 21820441.0.

Notification of Reasons for Refusal dated Feb. 7, 2023 from the Japanese Patent Office in application No. 2022-502380.

Office Action issued Jul. 2, 2023 in Korean Application No. 10-2021-0064734.

Office Action issued Apr. 20, 2023 in Chinese Application No. 202180004619.8.

* cited by examiner

AEROSOL GENERATING DEVICE

CROSS REFERENCE TO RELATED APPLICATIONS

This application is a National Stage of International Application No. PCT/KR2021/012102 filed Sep. 7, 2021, claiming priority based on Korean Patent Application No. 10-2020-0113743 filed Sep. 7, 2020 and Korean Patent Application No. 10-2021-0064734 filed May 20, 2021.

TECHNICAL FIELD

The present disclosure relates to an aerosol generating device, and more particularly, to an aerosol generating device capable of preventing damage of a battery.

BACKGROUND ART

Recently, the demand for an alternative to a traditional combustive cigarette has increased. For example, there is growing demand for an aerosol generating device which generates an aerosol by heating an aerosol generating material included in a cigarette or a liquid storage without combustion.

DISCLOSURE

Technical Problem

A heater installed in the aerosol generating device may be heated according to a proportional-integral-derivative (PID) control scheme. In this case, however, a battery may be overloaded. Therefore, there is a need for an aerosol generating device capable of preventing damage to a battery.

The technical problems of the present disclosure are not limited to the above-described description, and other technical problems may be derived from the embodiments to be described hereinafter.

Technical Solution

According to an aspect of the present disclosure, an aerosol generating device includes a heater configured to heat an aerosol generating substance; and a controller configured to: control a current supplied to the heater without using feedback control such that the heater is heated to a pre-set reference temperature, and, when the temperature of the heater reaches the reference temperature, control the current by using feedback control such that the heater is further heated from the reference temperature to a target temperature based on a difference between the temperature of the heater and the target temperature.

The controller may limit the current supplied to the heater to be smaller than or equal to a pre-set reference current until the heater is heated to the reference temperature.

The reference current may be 4 ampere (A).

The controller may control the current supplied to the heater to be equal to or larger than a minimum current for increasing the temperature of the heater at a certain speed or faster.

The minimum current may be 1 A.

The controller may set the reference current within a pre-set range.

The preset range may be 1 A to 4 A.

The reference temperature may be lower than the target temperature by 30° C. to 200° C.

The reference temperature may be determined based on the reference current.

The reference temperature may decrease as the reference current increases.

The controller may control to, when the heater is heated to the reference temperature, control the current according to a proportional-integrate-derivative (PID) control scheme.

The controller may control the current such that the temperature of the heater increases monotonically from when the heater begins to be heated until the temperature of the heater reaches the target temperature.

According to another aspect of the present disclosure, a method of controlling power supplied to a heater of an aerosol generating device includes controlling a current supplied to the heater without using feedback control, when the aerosol generating device is powered on; and, when the heater is heated to the reference temperature, controlling the current by using feedback control such that the heater is further heated from the reference temperature to a target temperature, based on a difference between the temperature of the heater and the target temperature.

The controlling the current without using feedback control may comprise limiting the current supplied to heater to be smaller than or equal to a pre-set reference current.

According to another aspect of the disclosure, there is provided a computer-readable recording medium having recorded thereon a computer program for implementing the method.

Advantageous Effects

An aerosol generating device according to the present disclosure may prevent a battery of the aerosol generating device from being damaged due to a ripple component of a current.

Also, an aerosol generating device according to the present disclosure may prevent an overshoot phenomenon that causes carbonization of a substance and unpleasant impression to a user due to rapid increase of temperature of a heater beyond a target temperature.

MODE FOR INVENTION

With respect to the terms in the various embodiments of the present disclosure, the general terms which are currently and widely used are selected in consideration of functions of structural elements in the various embodiments of the present disclosure. However, meanings of the terms may be changed according to intention, a judicial precedent, appearance of a new technology, and the like. In addition, in certain cases, there is also a term arbitrarily selected by the applicant, in which case the meaning will be described in detail in the description of one or more embodiments. Therefore, the terms used in one or more embodiments should be defined based on the meanings of the terms and the general contents of one or more embodiments, rather than simply the names of the terms.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, exemplary embodiments of one or more embodiments will be described in detail with reference to the accompanying drawings. One or more embodiments may, however, be embodied in many different forms and should not be construed as being limited to the embodiments set forth herein.

Hereinafter, embodiments of one or more embodiments will be described in detail with reference to the drawings.

Figure 1:
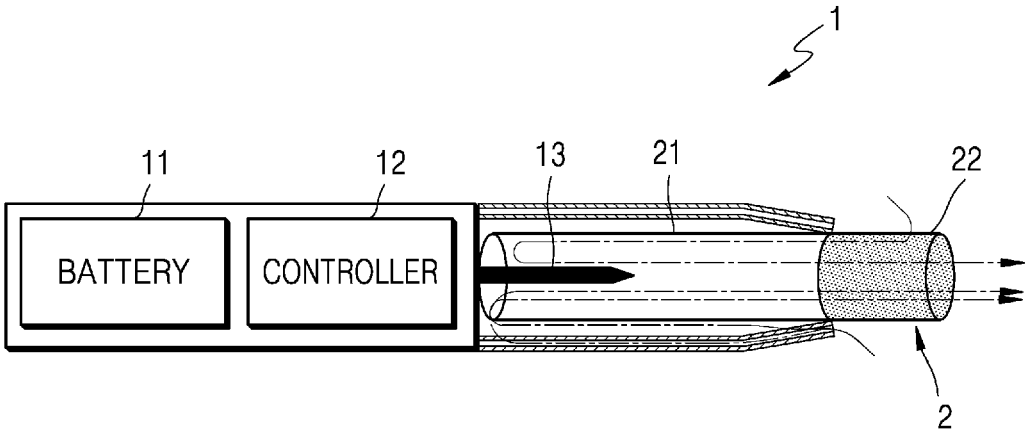
FIGS. 1 through 3 are diagrams showing examples in which a cigarette is inserted into an aerosol generating device.
Figure 2:
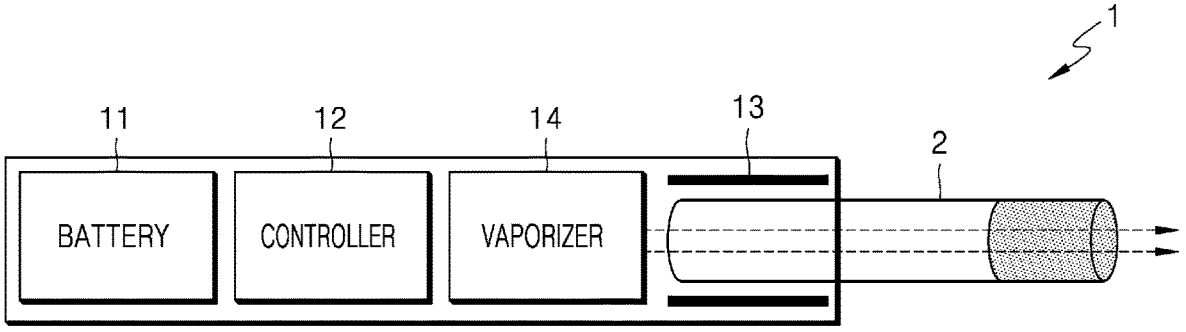
Figure 3:
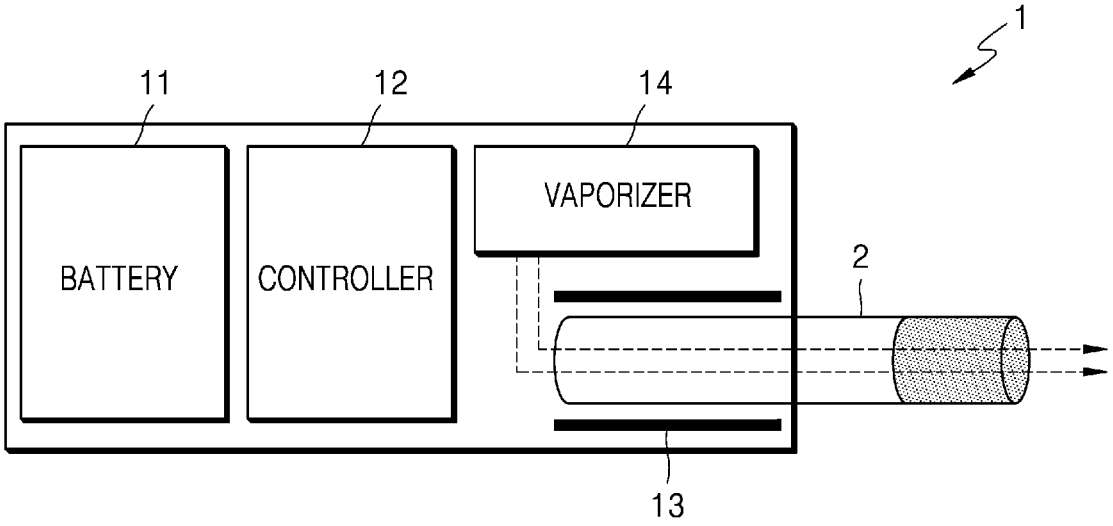

FIGS. 1 through 3 are diagrams showing examples in which a cigarette is inserted into an aerosol generating device.

Referring to FIG. 1, the aerosol generating device 1 may include a battery 11, a controller 12, and a heater 13. Referring to FIGS. 2 and 3, the aerosol generating device 1 may further include a vaporizer 14. Also, the aerosol generating article 2 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other general-purpose components may be further included in the aerosol generating device 1, in addition to the components illustrated in FIGS. 1 through 3.

Also, FIGS. 2 and 3 illustrate that the aerosol generating device 1 includes the heater 13. However, as necessary, the heater 13 may be omitted.

FIG. 1 illustrates that the battery 11, the controller 12, and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the aerosol generating article 2 is inserted into the aerosol generating device 1, the aerosol generating device 1 may operate the heater 13 and/or the vaporizer 14 to generate aerosol. The aerosol generated by the heater 13 and/or the vaporizer 14 is delivered to a user by passing through the aerosol generating article 2.

As necessary, even when the aerosol generating article 2 is not inserted into the aerosol generating device 1, the aerosol generating device 1 may heat the heater 13.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may generally control operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the aerosol generating article 2 is inserted into the aerosol generating device 1, the heater 13 may be located outside the aerosol generating article 2. Thus, the heated heater 13 may increase a temperature of an aerosol generating material in the aerosol generating article 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set by a user.

As another example, the heater 13 may include an induction heater. In detail, the heater 13 may include an electrically conductive coil for heating an aerosol generating article in an induction heating method, and the aerosol generating article may include a susceptor which may be heated by the induction heater.

For example, the heater 13 may include a tube-type heating element, a plate-type heating element, a needle-type heating element, or a rod-type heating element, and may heat the inside or the outside of the aerosol generating article 2, according to the shape of the heating element.

Also, the aerosol generating device 1 may include a plurality of heaters 13. Here, the plurality of heaters 13 may be inserted into the aerosol generating article 2 or may be arranged outside the aerosol generating article 2. Also, some of the plurality of heaters 13 may be inserted into the aerosol generating article 2 and the others may be arranged outside the aerosol generating article 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the aerosol generating article 2 to be delivered to a user. In other words, the aerosol generated via the vaporizer 14 may move along an air flow passage of the aerosol generating device 1 and the air flow passage may be configured such that the aerosol generated via the vaporizer 14 passes through the aerosol generating article 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further include general-purpose components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor (e.g., a puff sensor, a temperature sensor, an aerosol generating article insertion detecting sensor, etc.). Also, the aerosol generating device 1 may be formed as a structure that, even when the aerosol generating article 2 is inserted into the aerosol generating device 1, may introduce external air or discharge internal air.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated when the cradle and the aerosol generating device 1 are coupled to each other.

The aerosol generating article 2 may be similar to a general combustive cigarette. For example, the aerosol generating article 2 may be divided into a first portion including an aerosol generating material and a second portion including a filter, etc. Alternatively, the second portion of the aerosol generating article 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1, or the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, opening and closing of the air passage and/or a size of the air passage formed in the aerosol generating device 1 may be adjusted by the user. Accordingly, the amount of smoke and a smoking impression may be adjusted by the user. As another example, the external air may flow into the aerosol generating article 2 through at least one hole formed in a surface of the aerosol generating article 2.

Hereinafter, the examples of the aerosol generating article 2 will be described with reference to FIGS. 4 and 5.

Figure 4:
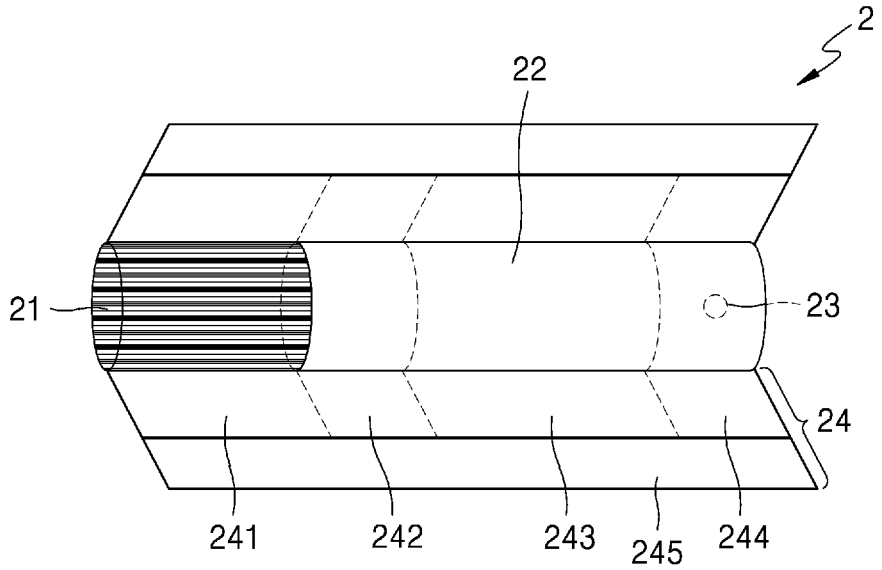
FIGS. 4 and 5 are diagrams showing examples of a cigarette.
Figure 5:
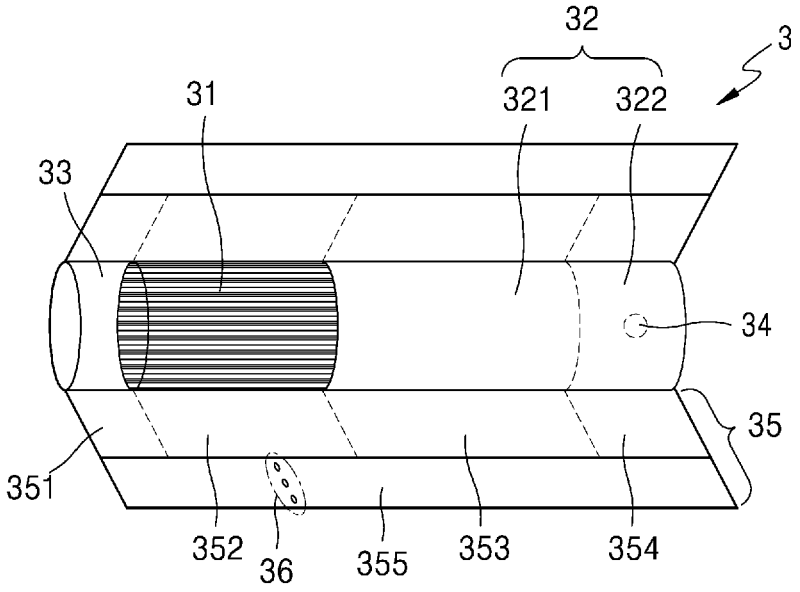

FIGS. 4 and 5 illustrate examples of the aerosol generating article.

Referring to FIG. 4, the aerosol generating article 2 may include a tobacco rod 21 and a filter rod 22. The first portion described above with reference to FIGS. 1 through 3 may include the tobacco rod 21, and the second portion may include the filter rod 22.

FIG. 4 illustrates that the filter rod 22 includes a single segment. However, the filter rod 22 is not limited thereto. In other words, the filter rod 22 may include a plurality of segments. For example, the filter rod 22 may include a first segment configured to cool an aerosol and a second segment configured to filter a certain component included in the aerosol. Also, as necessary, the filter rod 22 may further include at least one segment configured to perform other functions.

The aerosol generating article 2 may be packaged using at least one wrapper 24. The wrapper 24 may have at least one hole through which external air may be introduced or internal air may be discharged. For example, the aerosol generating article 2 may be packaged by one wrapper 24. As another example, the aerosol generating article 2 may be double-packaged by two or more wrappers 24. For example, the tobacco rod 21 may be packaged by a first wrapper 241, and the filter rod 22 may be packaged by wrappers 242, 243, 244. Also, the entire aerosol generating article 2 may be re-packaged by another single wrapper 245. When the filter rod 22 includes a plurality of segments, each segment may be individually packaged by wrappers 242, 243, 244.

The tobacco rod 21 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which is injected to the tobacco rod 21.

The tobacco rod 21 may be manufactured in various forms. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat-conducting material may be, but is not limited to, a metal foil such as aluminum foil. For example, the heat conductive material surrounding the tobacco rod 21 may uniformly distribute heat transmitted to the tobacco rod 21, and thus, the heat conductivity applied to the tobacco rod may be increased and taste of the tobacco may be improved. Also, the heat conductive material surrounding the tobacco rod 21 may function as a susceptor heated by the induction heater. Here, although not illustrated in the drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

Also, the filter rod 22 may include at least one capsule 23. Here, the capsule 23 may generate a flavor or an aerosol. For example, the capsule 23 may have a configuration in which a liquid containing a flavoring material is wrapped with a film. For example, the capsule 23 may have a spherical or cylindrical shape, but is not limited thereto.

Referring to FIG. 5, the aerosol generating article 3 may further include a front-end plug 33. The front-end plug 33 may be located on one side of the tobacco rod 31 which is not facing the filter rod 32. The front-end plug 33 may prevent the tobacco rod 31 from being detached from the filter rod 32 and prevent the liquefied aerosol from flowing from the tobacco rod 31 into the aerosol generating device (1 of FIGS. 1 through 3), during smoking.

The filter rod 32 may include a first segment 321 and a second segment 322. Here, the first segment 321 may correspond to the first segment of the filter rod 22 of FIG. 4, and the second segment 322 may correspond to the second segment of the filter rod 22 of FIG. 4.

A diameter and a total length of the aerosol generating article 3 may correspond to a diameter and a total length of the aerosol generating article 2 of FIG. 4. For example, the length of The front-end plug 33 is about 7 mm, the length of the tobacco rod 31 is about 15 mm, the length of the first segment 321 is about 12 mm, and the length of the second segment 322 is about 14 mm, but it is not limited thereto.

The aerosol generating article 3 may be packaged using at least one wrapper 35. The wrapper 35 may have at least one hole through which external air may be introduced or internal air may be discharged. For example, the front end plug 33 may be packaged by a first wrapper 351, the tobacco rod 31 may be packaged by a second wrapper 352, the first segment 321 may be packaged by a third wrapper 353, and the second segment 322 may be packaged by a fourth wrapper 354. Further, the entire aerosol generating article 3 may be repackaged by a fifth wrapper 355.

In addition, at least one perforation 36 may be formed in the fifth wrapper 355. For example, the perforation 36 may be formed in a region surrounding the tobacco rod 31, but is not limited thereto. The perforation 36 may serve to transfer heat generated by the heater 13 illustrated in FIGS. 2 and 3 to the inside of the tobacco rod 31.

In addition, at least one capsule 34 may be included in the second segment 322. Here, the capsule 34 may generate a flavor or an aerosol. For example, the capsule 34 may have a configuration in which a liquid containing a flavoring material is wrapped with a film. For example, the capsule 34 may have a spherical or cylindrical shape, but is not limited thereto.

Figure 6:
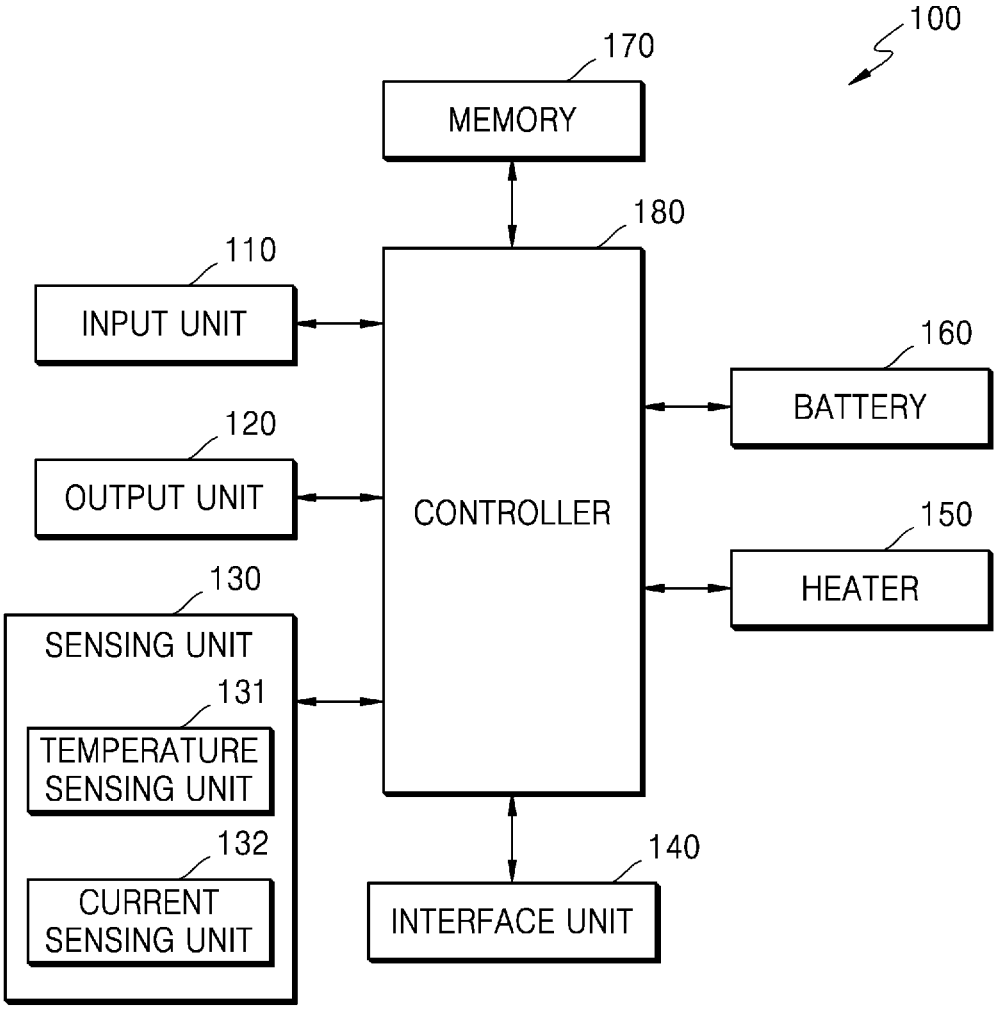
FIG. 6 is an internal block diagram of an aerosol generating device according to an embodiment.

FIG. 6 is an internal block diagram of an aerosol generating device according to an embodiment.

Referring to FIG. 6, the aerosol generating device 100 may include an input unit 110, an output unit 120, a sensing unit 130, an interface unit 140, a heater 150, a battery 160, a memory 170, and a controller 180. The aerosol generating device 100 of FIG. 6 may correspond to the aerosol generating device 1 of FIGS. 1 to 3. Also, the battery 160 of FIG. 6 may correspond to the battery 11 of FIG. 3, and the controller 180 of FIG. 6 may correspond to the controller 12 of FIG. 3.

The input unit 110 may receive a user input. For example, the input unit 110 may be provided in the form of a button, but is not limited thereto.

When a user input is received, the input unit 110 may transmit a control signal corresponding to the user input to the controller 180. The controller 180 may control the internal components of the aerosol generating device 100 based on a control signal. For example, the controller 180 may heat the heater 150 based on a control signal.

The output unit 120 may output visual information and/or tactile information related to the aerosol generating device 100. To this end, the output unit 120 may include a display (not shown), a vibrating motor (not shown), etc.

The sensing unit 130 may include a temperature sensing unit 131 for measuring a temperature of the heater 150 and a current sensing unit 132 for measuring a current supplied to the heater 150. The temperature sensing unit 131 may include at least one temperature sensor, and the temperature sensor may be disposed close to the heater 150. The current sensing unit 132 may include at least one shunt resistor, but the present disclosure is not limited thereto.

According to embodiments, the sensing unit 130 may further include a puff sensor for sensing a puff of a user.

The interface unit 140 may serve as a path for communicating with various external devices connected to the aerosol generating device 100. For example, the interface unit 140 may include a port that may be connected to an external device, and the aerosol generating device 100 may be connected to the external device through the port. The aerosol generating device 100 may exchange data with an external device while being connected to the external device.

The interface unit 140 may also serve as a path for receiving external power. For example, the interface unit 140 may include a port that may be connected to an external power supply, and the aerosol generating device 100 may receive external power from the external power supply while being connected to the external power supply.

The heater 150 may be an electrically resistive heater or an induction heater. When the heater 150 is an electrically resistive heater, the heater 150 may include an electro-conductive track. The heater 150 may be heated by a current applied to the electro-conductive track. When the heater 150 is an induction heater, the heater 150 may include an electro-conductive coil and a susceptor. When a current is applied to the electro-conductive coil, the susceptor may be heated by a variable magnetic field formed by the electro-conductive coil.

The battery 160 may supply power to the heater 150 under the control of the controller 180. The battery 160 may be, but is not limited to, a lithium-ion battery.

The memory 170 may store information for the operation of the aerosol generating device 100. In an embodiment, the memory 170 may store a temperature profile and information regarding a reference temperature at which a temperature feedback control period starts.

The controller 180 may control power supplied to the heater 150 by adjusting a frequency and/or a duty cycle of current pulses supplied to the heater 150 by the battery 160. For example, the controller 180 may increase power supplied to the heater 150 by increasing the frequency and the duty cycle through pulse width modulation.

The controller 180 may set a target temperature for the heater 150. For example, the target temperature may be 335° C. Also, the controller 180 may control the temperature of the heater 150 based on a difference between the temperature of the heater 150 and the target temperature. In other words, the controller 180 may perform feedback control based on information regarding the temperature of the heater 150.

In detail, the controller 180 may control power supplied to the heater 150 according to a feedback control scheme based on a difference between the temperature of the heater 150 and the target temperature, an integral value obtained by integrating the difference over time, and a differential value obtained by differentiating the difference over time.

For example, the controller 180 may control the temperature of the heater 150 according to a proportional-integral-derivative (PID) control scheme. Coefficients for PID control may be experimentally set in advance for optimally controlling the temperature of the heater 150. The controller 180 may control the temperature of the heater 150, such that the temperature of the heater 150 reaches the target temperature, according to set coefficients for PID control.

Meanwhile, if the heater 150 is heated according to the PID control scheme from the beginning of heating, the battery 160 may be overloaded due to the ripple component of a current. Also, the ripple component of a current may work as electromotive force noise, thereby causing serious damage to the battery 160.

To resolve the above-stated problems, the aerosol generating device 100 according to the present disclosure may heat the heater 150 according to a current-limiting scheme before the temperature of the heater 150 is increased to the target temperature through the PID control scheme.

In detail, the controller 180 may limit the current supplied to the heater 150 during the initial stage of heating. The controller 180 may limit the current supplied to the heater 150 to be smaller than or equal to a pre-set reference current. The reference current may be set between 1 ampere (A) and 4 A. The reason for setting the bottom end of the reference current to 1 A is that the minimum current required to heat the heater 150 is 1 A. Also, the reason for setting the upper end of the reference current to 4 A is that a rated current of the battery 160 is 6 A and the sum of currents required by components other than the heater 150 is 2 A. For example, the reference current may be set to 1.95 A.

The controller 180 may heat the heater 150 according to the current-limiting scheme until the temperature of the heater 150 reaches a pre-set reference temperature. The reference temperature may be set based on whether overshoot of the heater 150 may be controlled. For example, the reference temperature may be set to be lower than the target temperature by 30° C. to 200° C. For example, when the reference current is 1.95 A, the reference temperature may be set to be 35° C. lower than the target temperature.

Meanwhile, as the reference current increases, the temperature of the heater 150 may increase faster. Therefore, in consideration of overshoot, as the reference current increases, the reference temperature may decrease. For example, if the reference current is set to be larger than 1.95 A, the reference temperature may be set to be lower than the target temperature by more than 35° C.

As described above, the aerosol generating device 100 according to the present disclosure adjusts the current supplied to the heater 150 at the early stage of heating the heater 150, thereby preventing damage to the battery 160 caused by the ripple component of the current. More particularly, the controller 180 limits the current to be smaller than or equal to a reference current.

Figure 7:
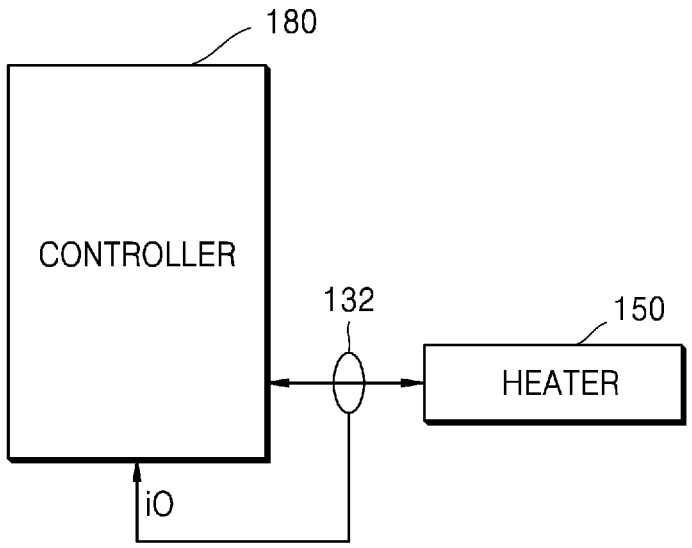
FIG. 7 is a diagram for describing a current limiting method according to an embodiment.

FIG. 7 is a diagram for describing a current limiting method according to an embodiment.

Referring to FIG. 7, the current sensing unit 132 may sense a current supplied to the heater 150. The current sensing unit 132 may transmit current information to the controller 180.

The controller 180 may limit the current supplied to the heater 150 based on the current information.

As shown in FIG. 7, the aerosol generating device 100 according to the present disclosure may limit the current supplied to the heater 150 under the control of the controller 180.

Figure 8:
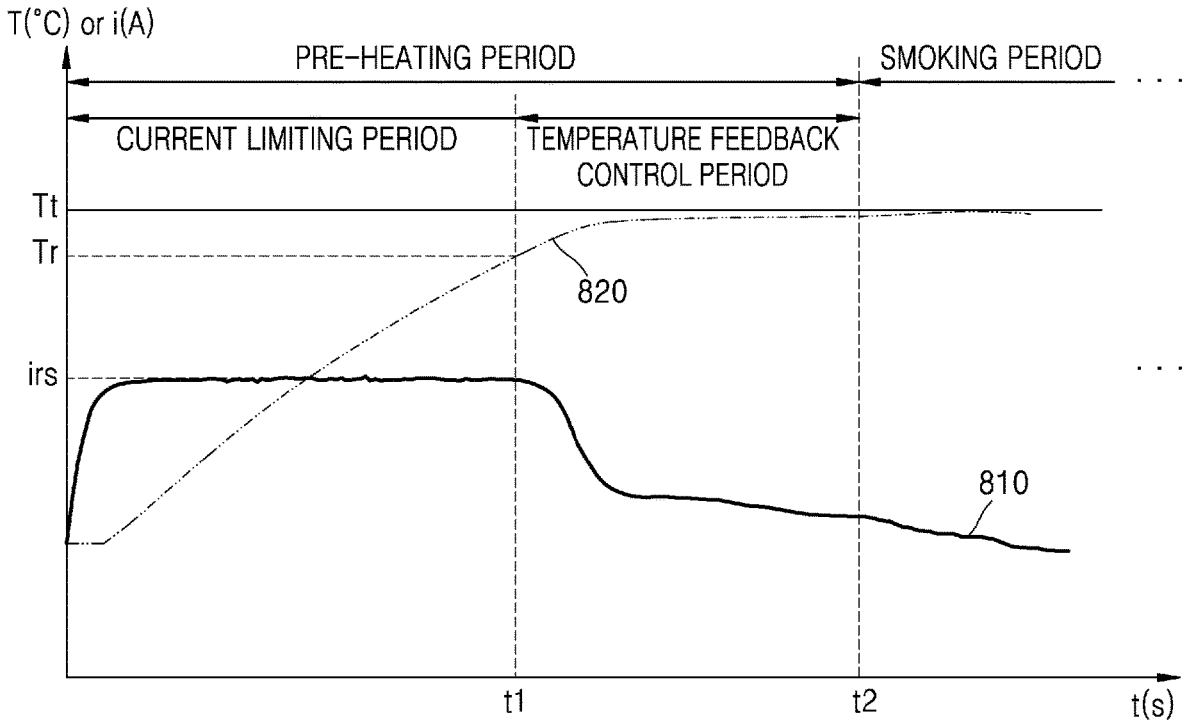
FIG. 8 is a diagram for describing a pre-heating method according to an embodiment.

FIG. 8 is a diagram for describing a pre-heating method according to an embodiment.

FIG. 8 shows a temperature 820 of the heater 150 and a current 810 supplied to the heater 150. Referring to FIG. 8, the controller 180 may control power supplied to the heater 150 during a pre-heating period and a smoking period.

The pre-heating period may refer to a period in which the temperature of the heater 150 is heated to a target temperature Tt at which an aerosol is generated from an aerosol generating substance (i.e., aerosol generating material). If the heater 150 is an induction heater, the temperature 820 of the heater 150 may refer to the temperature of a susceptor that directly contacts an aerosol generating substance. The smoking period may refer to a period in which the temperature of the heater 150 is maintained at the target temperature Tt.

The target temperature Tt may be set differently according to the types of aerosol generating substances. For example, the target temperature Tt may be set to 335° C.

The controller 180 may control power supplied to the heater 150 in the pre-heating period, such that the temperature of the heater 150 reaches the target temperature Tt within a short period of time.

The controller 180 may limit the current supplied to the heater 150 to be smaller than or equal to a pre-set reference current irs in a current limiting period (i.e., between the preheating start point and a first time point t1). The reference current irs may be set within a range from 1 A to 4 A. For example, the reference current irs may be set to 1.95 A.

The controller 180 may receive information regarding the temperature of the heater 150 while the current supplied to the heater 150 is limited. The controller 180 may heat the heater 150 according to the current-limiting scheme until the temperature of the heater 150 reaches a pre-set reference temperature Tr. The reference temperature Tr may be set in a range of (Tt-200) ° C. to (Tt-30) ° C. in consideration of overshoot control of the heater 150. For example, if the reference current irs is 1.95 A, the reference temperature Tr may be set to 300° C., which is 35° C. lower than the target temperature Tt.

When the temperature of the heater 150 reaches the reference temperature Tr at the first time point t1, the current limiting period ends and a temperature feedback control period in which the temperature of the heater 150 is further heated to the target temperature Tt begins.

In the temperature feedback control period, the controller 180 may perform feedback control based on a difference between the temperature of the heater 150 and the target temperature Tt. The controller 180 may control the temperature of the heater 150 according to the PID control scheme. The controller 180 may control the temperature of the heater 150, such that the temperature of the heater 150 reaches the target temperature Tt, according to PID coefficients.

Meanwhile, the current limiting period may be referred to as a first pre-heating period, and the temperature feedback control period may be referred to as a second pre-heating period.

When a pre-set pre-heating period ends at a second time point t2, the controller 180 may switch to the smoking period and maintain the temperature of the heater 150 at the target temperature Tt.

Figure 9:
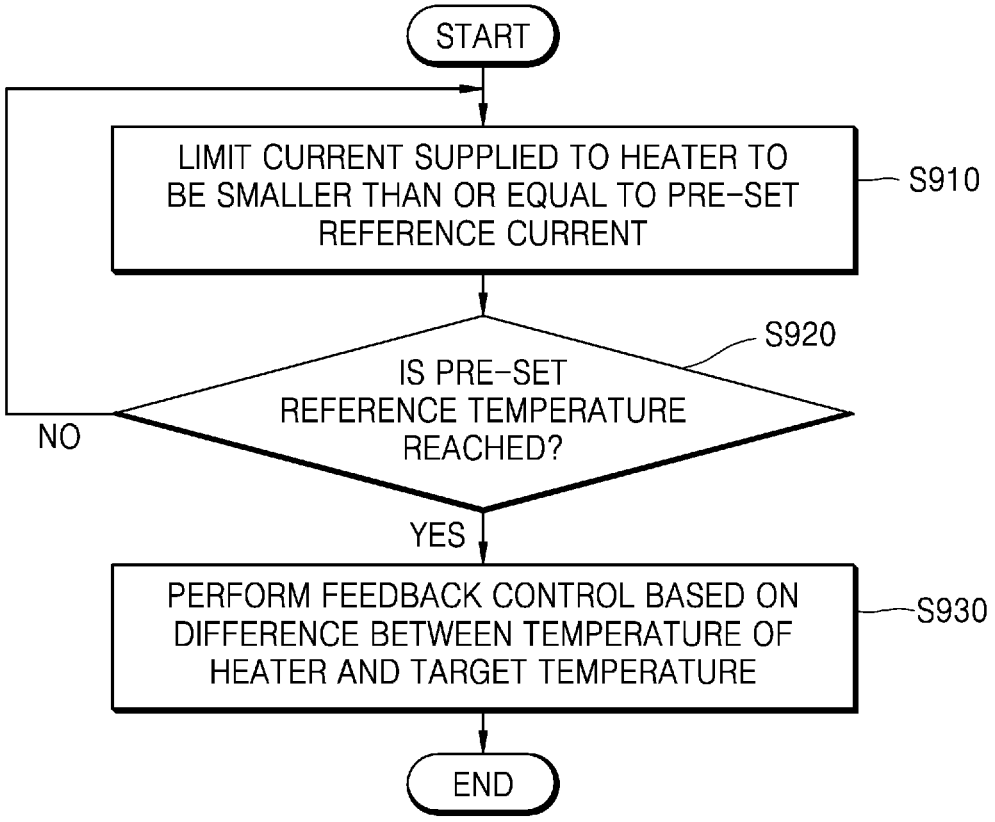
FIG. 9 is a flowchart of a method of operating an aerosol generating device according to an embodiment.

FIG. 9 is a flowchart of a method of operating an aerosol generating device according to an embodiment.

Referring to FIG. 9, the controller 180 may limit the current supplied to the heater 150 to be smaller than or equal to a pre-set reference current (operation S910). The reference current may be set in a range of 1 A to 4 A. For example, the reference current may be set to 1.95 A.

The controller 180 may determine whether the temperature of the heater 150 has reached a reference temperature (operation S920). If the temperature of the heater 150 is below the reference temperature, the controller 180 may maintain a current limiting scheme.

If the temperature of the heater 150 is equal to or higher than the reference temperature, the controller 180 may perform feedback control based on a difference between the temperature of the heater 150 and a target temperature (operation S930). That is, the controller 180 may control the temperature of the heater 150 to reach the target temperature, according to PID coefficients.

Figure 10:
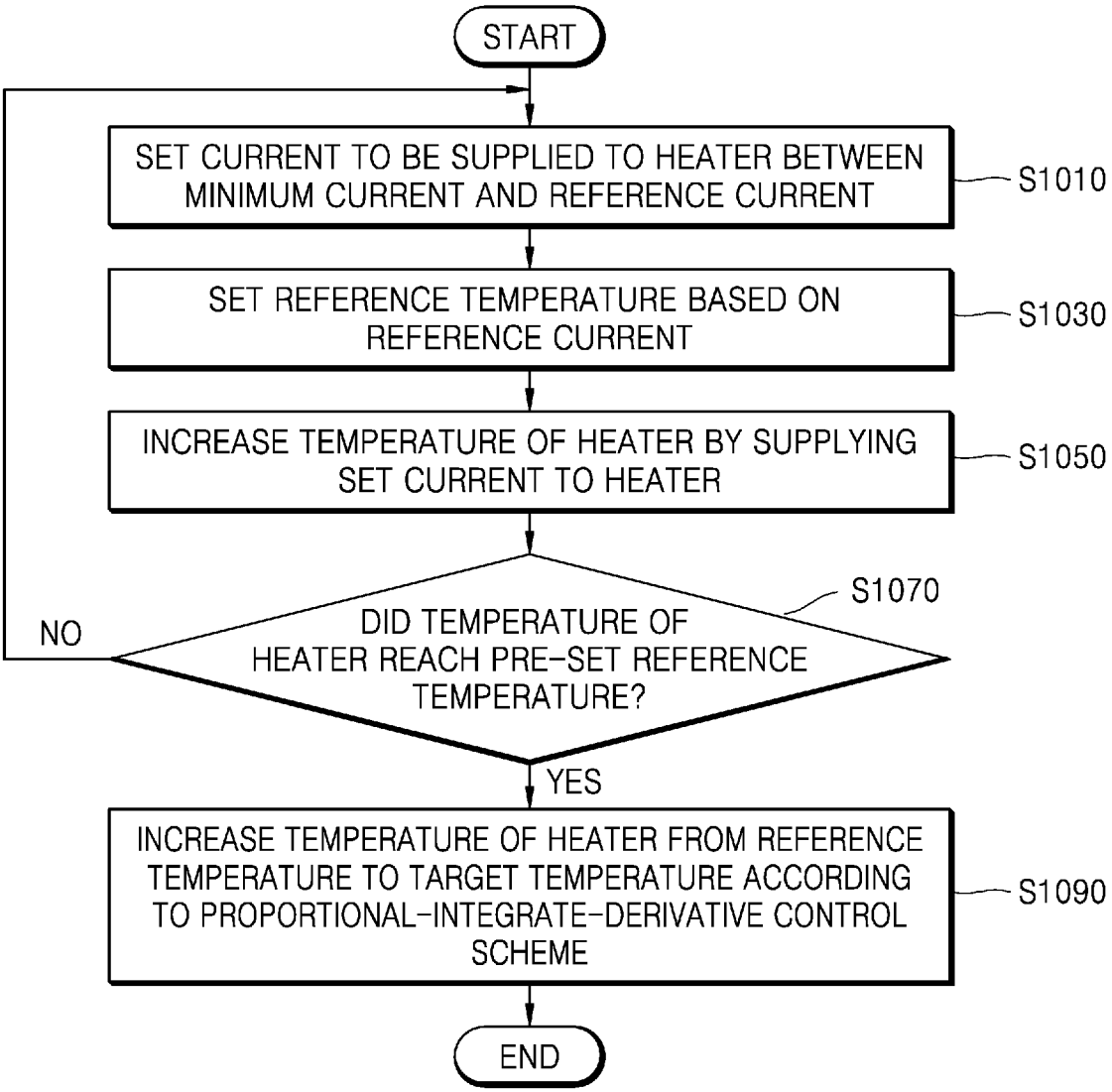
FIG. 10 is a flowchart of a method of operating an aerosol generating device according to another embodiment.

FIG. 10 is a flowchart of a method of operating an aerosol generating device according to another embodiment.

FIG. 10 is a diagram for describing an embodiment that may be derived from the flowchart of FIG. 9 in detail. Hereinafter, descriptions identical to those given above with reference to FIG. 9 will be omitted.

First, when the aerosol generating device 100 is powered on, the controller 180 set the current to be supplied to the heater 150 between the minimum current and a reference current (operation S1010). Here, the minimum current is the smallest current required to increase the temperature of the heater 150 at a certain speed or faster. For example, the minimum current may be 1 A, which is the bottom end of the reference current range as described above. Also, in operation S1010, the reference current may be 4 A.

In operation S1010, the controller 180 controls the current supplied to the heater 150 not to exceed 4 A, thereby minimizing the ripple component of the current and preventing damage of a battery. At the same time, the controller 180 may control the current supplied to the heater 150 to be 1 A or larger, such that the heater 150 may be heated at least at a certain pre-heating speed. The controller 180 may appropriately set the current supplied to the heater 150 within the range of the minimum current to the reference current with reference to information obtained based on experiences or experiments, wherein the reference current may be 1.95 A as described above.

Next, the controller 180 sets a reference temperature based on the reference current (operation S1030). As described above with reference to FIGS. 6 and 8, the reference temperature may be set to be lower than the target temperature by 30° C. to 200° C. For example, if the target temperature of the heater 150 is 335° C., the reference temperature of the heater 150 may be set between 135° C. and 305° C. Here, one of factors used for the controller 180 to set the reference temperature between 135° C. and 305° C. is the reference current. More particularly, as the reference current increases, the reference temperature set by the controller 180 decreases. In operation S1030, a relationship between the reference current and the reference temperature may be expressed as shown in Equation 1 below.

$$Tr = \frac{k}{irs} \quad \text{[Equation 1]}$$

*125Equation 1 shows a correlation between a reference temperature set by the controller 180 and the reference current. In Equation 1, Tr denotes a reference temperature, irs denotes the reference current, and k denotes a proportional constant. Equation 1 shows an inversely proportional relationship. That is, as the reference current increases, the reference temperature decreases. The constant k may be determined such that the overshoot of the heater 150 is prevented (i.e., such that the heater 150 is not overheated beyond the target temperature). Since the overshoot of the heater 150 is prevented, carbonization of an aerosol generating substance, which causes an unpleasant smoking experience, is prevented.

Next, the controller 180 controls the battery 160 to supply a current corresponding to the value set in S1010 to the heater 150, thereby increasing the temperature of the heater 150 to the reference temperature set in operation S1030 (operation S1050).

The controller 180 determines whether the temperature of the heater 150 reached the reference temperature set in S1030 (operation S1070). In operation S1070, if the temperature of the heater 150 has reached the reference temperature, the controller 180 controls the temperature of the heater 150 according to the PID control scheme until the temperature of the heater 150 reaches the target temperature (operation S1090). Through operations S1030 to S1070, the temperature of the heater 150 monotonically increases from the initial temperature of the heater 150 to the target temperature without causing a ripple current and overshoot. As a result, the aerosol generating device 100 according to the present disclosure may prevent damage to a battery, thereby improve stability of the aerosol generating device 100 and providing a satisfactory smoking experience to a user.

The aerosol generating device 100 according to the present disclosure controls power supplied to the heater 150 according to the current limiting scheme instead of the PID control scheme in the early stage of pre-heating, thereby reducing ripple components of a current. Therefore, the battery 160 may be kept from being overloaded, and damage to the battery 160 due to EMF noise may be prevented.

One or more embodiments described above may be implemented in the form of a computer program that may be executed on a computer through various components, and such a computer program may be recorded in a computer-readable recording medium. At this time, the computer-readable recording medium may be a magnetic medium (e.g., a hard disk, a floppy disk, and a magnetic tape), an optical recording medium (e.g., a CD-ROM and a DVD), a magneto-optical medium (e.g., a floptical disk), and a hardware device specifically configured to store and execute program instructions (e.g., a ROM, a RAM, and a flash memory).

Meanwhile, the computer program recorded on the medium may be specially designed and configured for example embodiments or may be published and available to one of ordinary skill in computer software. Examples of computer programs include machine language code such as code generated by a compiler, as well as high-level language code that may be executed by a computer using an interpreter or the like.

Specific implementations described in one or more embodiments are examples, and do not limit the scope of one or more embodiments in any way. For brevity of description, descriptions of conventional electronic components, control systems, software, and other functional aspects of the systems may be omitted. Furthermore, the connecting lines, or connectors shown in the various figures presented are intended to represent exemplary functional relationships and/or physical or logical couplings between the various elements, and it should be noted that many alternative or additional functional relationships, physical connections or circuit connections may be present in a practical device. Moreover, no item or component is essential to the practice of one or more embodiments unless the element is specifically described as "essential" or "critical".

The use of the terms "a" and "an" and "the" and similar referents in the context of describing one or more embodiments (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Also, the steps of all methods described herein can be performed in any suitable order unless otherwise indicated herein or otherwise clearly contradicted by context. One or more embodiments are not limited to the described order of the steps. The use of any and all examples, or exemplary language (e.g., "such as") provided herein, is intended merely to better illuminate the present disclosure and does not pose a limitation on the scope of one or more embodiments unless otherwise claimed. Numerous modifications and adaptations will be readily apparent to one of ordinary skill in the art without departing from the spirit and scope of one or more embodiments.

The invention claimed is:

1. An aerosol generating device comprising:

a heater configured to heat an aerosol generating substance;

a battery configured to supply power to be used for the aerosol generating device to operate; and a controller configured to:

set a current supplied to the heater within a pre-set range between a minimum current and a maximum current of a reference current, wherein the maximum current of the reference current is defined as a value obtained by subtracting, from a rated current of the battery, a sum of currents required by components other than the heater, set a reference temperature based on the reference current wherein the reference temperature and the reference current have an inversely proportional relationship, during a first pre-heating period, control a current supplied to the heater without using feedback control, by limiting the current to be less than or equal to the reference current, such that the heater is heated to the reference temperature, and during a second pre-heating period, after the heater is heated to the reference temperature, control the current, without limiting the current to be less than or equal to the reference current, by using feedback control such that the heater is further heated from the reference temperature to a target temperature, based on a difference between a temperature of the heater and the target temperature.

2. The aerosol generating device of claim 1, wherein the reference current is 4 ampere (A).

3. The aerosol generating device of claim 1, wherein the controller is further configured to control the current supplied to the heater to be equal to or larger than the minimum current for increasing the temperature of the heater at a certain speed or faster.

4. The aerosol generating device of claim 3, wherein the minimum current is 1 A.

5. The aerosol generating device of claim 1, wherein the pre-set range is 1 A to 4 A.

6. The aerosol generating device of claim 1, wherein the reference temperature is lower than the target temperature by 30° C. to 200° C.

7. The aerosol generating device of claim 1, wherein the reference temperature is determined based on the reference current.

8. The aerosol generating device of claim 1, wherein the controller is further configured to, when the heater is heated to the reference temperature, control the current according to a proportional-integrate-derivative (PID) control scheme.

9. The aerosol generating device of claim 1, wherein the controller is further configured to control the current such that the temperature of the heater increases monotonically from when the heater begins to be heated until the temperature of the heater reaches the target temperature.

* * * * *